US005315211A

United States Patent [19]

Ditlevsen et al.

[11] Patent Number: 5,315,211

[45] Date of Patent: May 24, 1994

[54] INSULATOR FOR FLUORESCENT LAMP

[75] Inventors: Claes Ditlevsen, Silkeborg, Denmark; Dusan P. Pope, Santa Clarita, Calif.; Artak Ter-Oganesian, Glendale, Calif.; Gary F. Paugh, Long Beach, Calif.

[73] Assignee: Anthony's Manufacturing Company, Inc., San Fernando, Calif.

[21] Appl. No.: 887,790

[22] Filed: May 29, 1992

[51] Int. Cl.[5] ..... H01J 61/52

[52] U.S. Cl. ..... 315/50; 315/363; 362/294; 313/47

[58] Field of Search ..... 315/50, 363; 362/260, 362/294; 313/27, 47

[56] References Cited

U.S. PATENT DOCUMENTS

| | | | |
|---|---|---|---|
| 3,426,234 | 2/1969 | Hayasaka et al. | 362/457 X |
| 3,720,826 | 3/1973 | Gilmore et al. | 362/377 |
| 3,751,653 | 8/1973 | Henry | 362/126 |
| 3,808,495 | 4/1974 | Win | 362/376 |
| 4,147,947 | 4/1979 | Hoeh | 313/27 |
| 5,188,451 | 2/1993 | Shanks | 362/294 |

*Primary Examiner*—Tony M. Argenbright

*Attorney, Agent, or Firm*—Poms, Smith, Lande & Rose

[57] ABSTRACT

An insulator is applied to the ends of a fluorescent lamp which operates in a cold environment. The insulator retains the heat generated by the fluorescent lamp in order to reduce the energy which must be applied to cause the lamp to fire.

13 Claims, 5 Drawing Sheets

FIG. 1
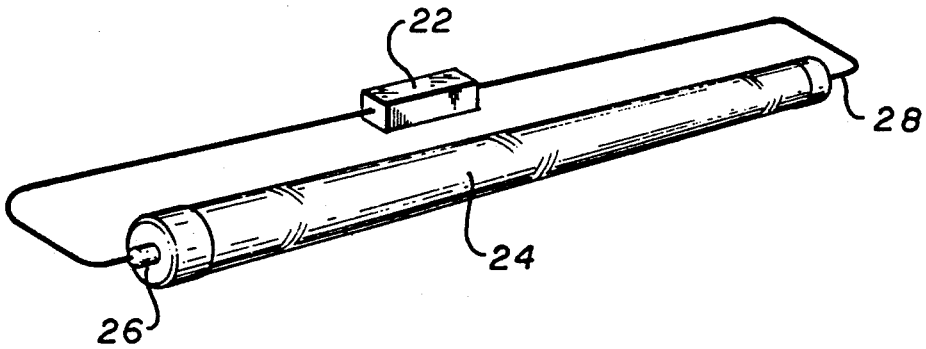
FIG. 2
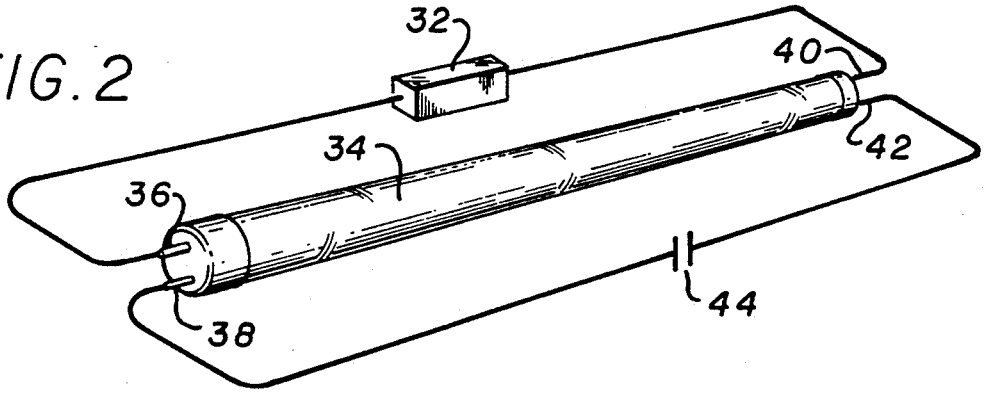
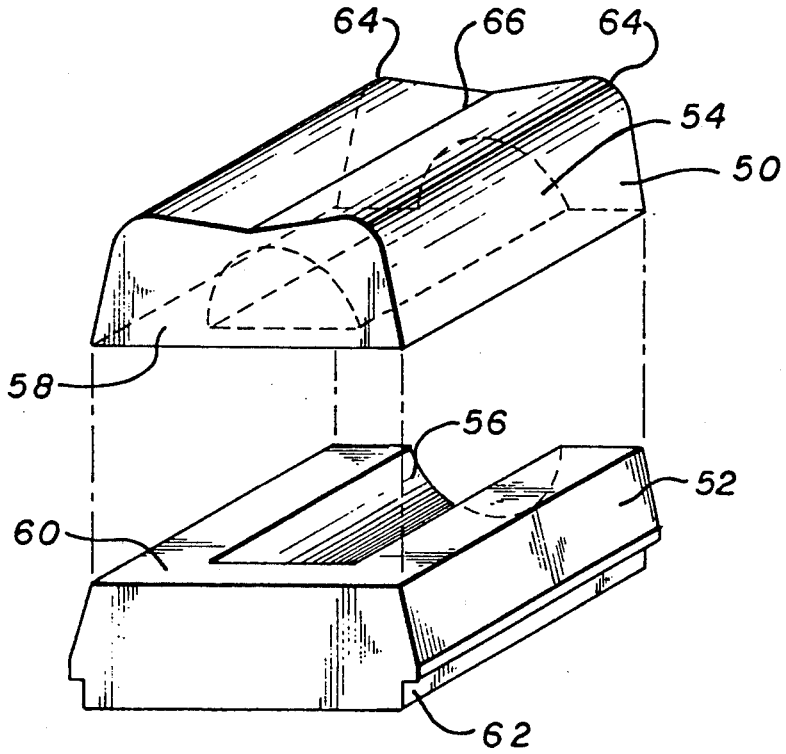
FIG. 3

FIG. 4
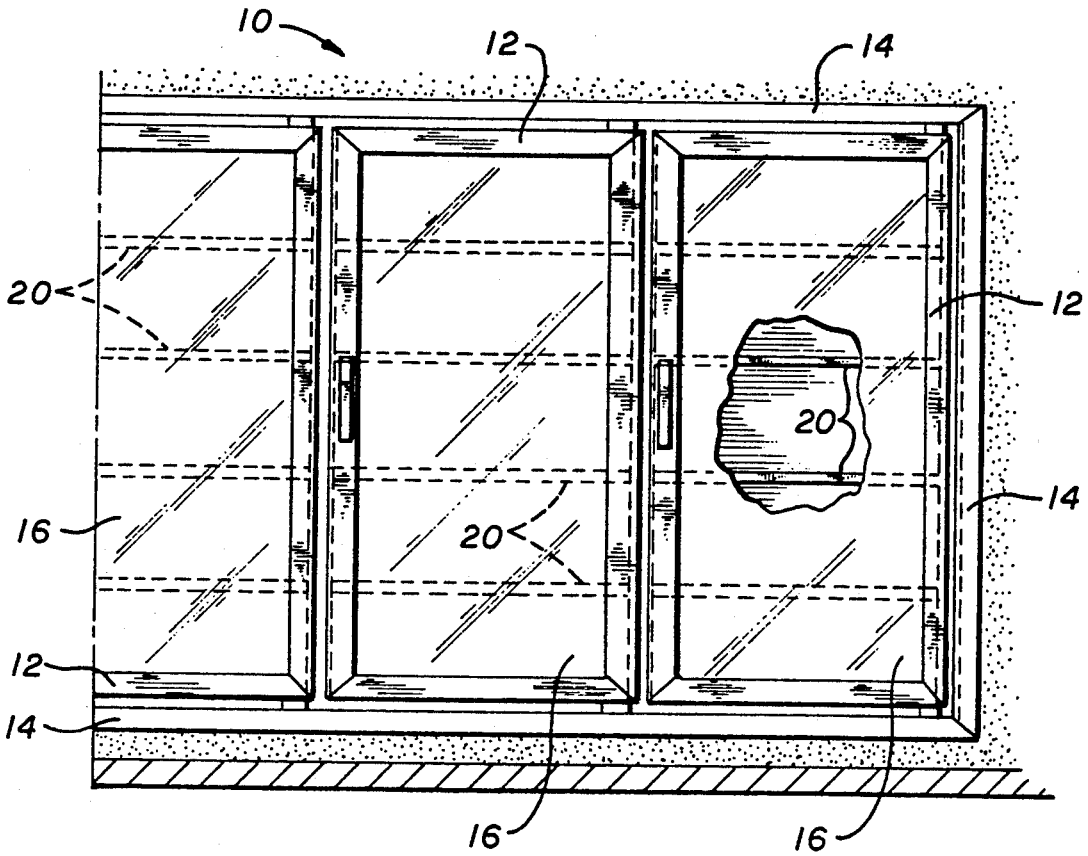
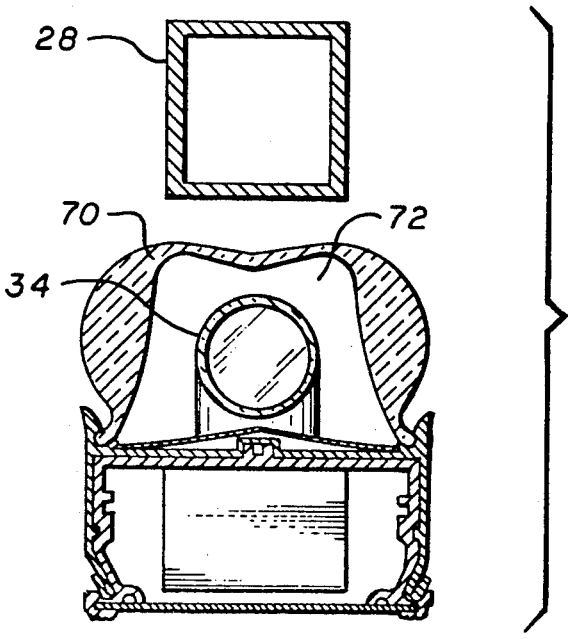
FIG. 5

INSULATOR FOR FLUORESCENT LAMP

FIELD OF THE INVENTION

The present invention relates generally to fluorescent lamps, specifically to fluorescent lamps operating in a reduced temperature or low temperature environment, such as in a refrigerator or freezer case.

BACKGROUND OF THE INVENTION

Fluorescent lamps are widely used to provide light. Fluorescent lamps are generally preferred over incandescent type lamps because their light output is superior to the light output for the same power of incandescent type lamp. Additionally, fluorescent lamps tend to generate less heat during operation. Fluorescent lamps have found themselves employed in a variety of locations, including high and low temperature applications. Fluorescent lamps used in low temperature applications are difficult to start and continue firing. The low temperature environment reduces the inherent energy available within the gas of the fluorescent lamp. This requires a higher voltage to be applied in order to cause the gas to generate light.

There are two main styles of fluorescent lamps currently on the market. One style is a two element fluorescent lamp which consists of a single electrode located at each end of the fluorescent lamp.

The second is a filament type which consists of a filament located at each end of the fluorescent lamp. A current flows through each filament, and a voltage of approximately 130 V is applied across the two filaments to cause the lamp to light. The current through each of the filaments generates heat, warming the gas surrounding each filament.

SUMMARY OF THE INVENTION

According to the present invention, insulator material is applied to either one or both ends of a fluorescent lamp. The insulator extends slightly beyond the position of the electrode or filament within the fluorescent lamp.

It is an object of the present invention to retain the heat generated in a fluorescent lamp within the fluorescent lamp.

It is a further object of this invention to reduce the voltage required to be applied to fluorescent lamps to fire the fluorescent lamps.

It is a further object of the present invention to enable fluorescent lamps to more reliably and more readily operate in low temperature environments.

The insulators of the present invention also provide moisture protection, preventing moisture from collecting at the electrodes located at either end of the fluorescent lamp. This provides additional safety to users of the fluorescent lamp. By preventing moisture from accumulating, the present invention reduces the chance that moisture which accumulates near the electrodes of the fluorescent lamp will cause the high voltage which is applied to the fluorescent lamp from discharging through the accumulated moisture to an adjacent ground, such as a refrigerator or freezer frame, thus exposing the user to a hazard of severe shock. This will also prevent or reduce corrosion which may otherwise develop at the fluorescent lamp electrodes.

BRIEF DESCRIPTION OF THE DRAWINGS

FIG. 1 is a cross-section view showing a two electrode type fluorescent lamp.

FIG. 2 is a cross-section view showing a filament type fluorescent lamp.

FIG. 3 is an isometric view of the insulator of the present invention.

FIG. 4 is an elevational view of a freezer display case having doors mounted thereon and shelves mounted inside the case.

FIG. 5 is a cross-sectional view showing the space surrounding the fluorescent lamp as it is mounted in the freezer display case of FIG. 4.

DESCRIPTION OF AN EXEMPLARY PREFERRED EMBODIMENT

Figure 6:
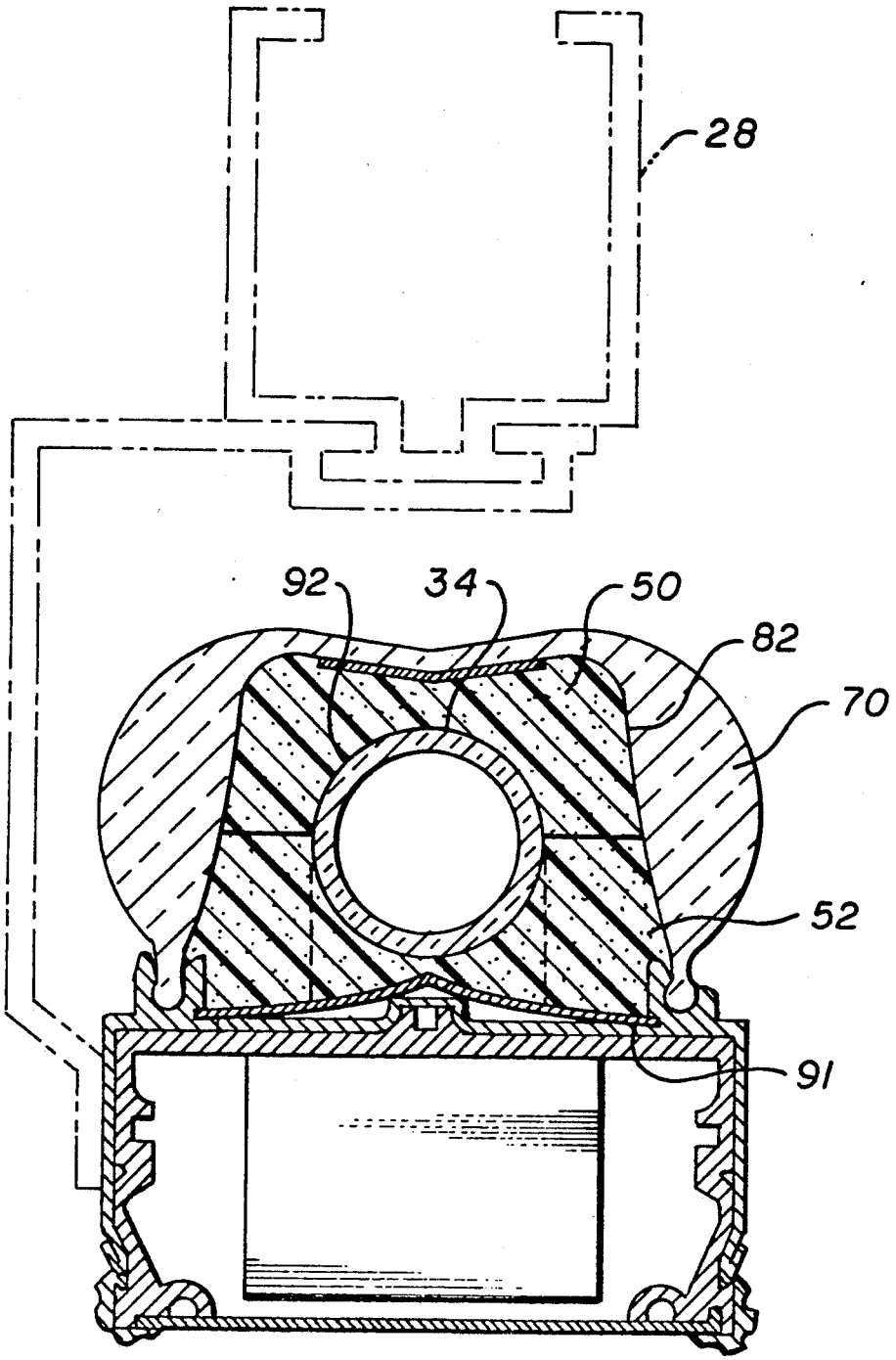
FIG. 6 is a cross-sectional view showing the insulator of the present invention occupying the space surrounding the fluorescent lamp as shown in FIG. 5.

The following specification taken in conjunction with the drawings sets forth the preferred embodiment of the present invention in such a manner that any person skilled in the art can make and use the invention. The embodiment of the invention disclosed herein is the best mode contemplated by the inventors for carrying out their invention in a commercial environment, although it should be understood that various modifications can be accomplished within the parameters of the present invention.

Referring to FIG. 4, a display case 10 of the present invention is shown having doors 12 mounted on a surrounding frame 14. The doors 12 have glass panels 16, which allow someone, such as a customer in a supermarket, to look through the panels 16 at items 18 displayed on shelves 20 inside the case 10. The items 18 inside the display case 10 may or may not be refrigerated items 18, such as frozen foods.

Referring to FIG. 1, there is shown an example of a two element fluorescent lamp 24. A ballast 22 generates a high voltage which is applied across electrodes 26 and 28. A two element fluorescent lamp consists of one electrode located at each end of the fluorescent lamp (electrodes 26 and 28). A sufficient amount of energy, usually a high voltage is applied between the two elements of this type of fluorescent lamp by a ballast 22 in order to cause the fluorescent lamp 24 to generate light. This type of fluorescent lamp 24 does not tend to generate heat at a specific point in the lamp such as at electrodes 26 or 28.

Referring to FIG. 2, there is shown a dual filament type fluorescent lamp 34. A ballast 32 generates a high voltage which is applied to the filaments of fluorescent lamp 34 through electrode 36. The current passes through the first filament located within the fluorescent lamp (not shown) and exits through electrode 38. The voltage applied to the first filament is coupled to the second filament (connected to electrodes 40 and 42) by an impedance such as capacitor 44 or an inductor. This type of fluorescent lamp is usually driven in a circuit configuration which causes the elements at each end of the fluorescent lamp 34 to heat prior to, or during discharge of the high voltage applied to the gas within the fluorescent lamp 34. By retaining the heat generated by the filament element at each end of this type of fluorescent lamp, the amount of energy, and hence voltage which is required in order to cause the gas to enter an energized state and discharge generating light, is decreased.

While it may appear desirable to insulate the entire fluorescent lamp, this may not be practical as insulators tend to be opaque, not transparent, thus restricting the light output from the fluorescent lamp. The present invention trades off insulating the entire length of the fluorescent tube with generating a light output from the fluorescent lamp. An insulator as shown in FIG. 3 is preferably applied to both ends of the dual filament type fluorescent lamp shown in FIG. 2. The insulator extends from the end of the lamp to a point slightly past the filament element. Since most of the heating of the lamp will occur at the filament element, it has been determined that it is of diminishing value to extend the insulator substantially beyond the filament element of the fluorescent lamp.

Insulators may also be employed with a two element fluorescent lamp 24 as shown in FIG. 1. The insulators will cause the lamp to retain heat, lessening the energy (and, therefore, the voltage) which must be applied to the lamp to get the lamp to fire.

The current which passes through the filaments of the filament type fluorescent lamp generates a predetermined amount of local heating. This makes the filament type fluorescent preferred for application of the insulators.

In one preferred embodiment, the insulator of the present invention includes an upper portion 50 and a lower portion 52. A rounded recess which conforms to the shape of the fluorescent lamp to be contained within the insulator is formed in sections 54 of the upper portion 50 of the insulator and section 56 formed in the lower portion 52 of the insulator. In the embodiment shown in FIG. 3, the recess portions 54 and 56 are approximately equal in size. Channels 54 and 56 do not extend the entire length of the portions 50 and 52 of the insulator.

Segment 58 is formed out of the same insulation material, and covers the bottom portion of the fluorescent lamp 34 when it is inserted between insulators 50 and 52. Similarly, segment 60 of the bottom portion 52 of the insulator covers the end of fluorescent lamp 32 which is placed within the bottom portion 52 of the insulator. As can be seen, there are no explicit grooves for electrodes 36 or 38, or for any wires to feed into, or out of either the upper portion 50 or lower portion 52 of the insulator. The insulator is formed of a substantially flexible material such as a foam or other malleable material. Thus, wires connected to electrodes 36 and 38 or electrodes 40 and 42 can be readily fed between the upper portion 50 and lower portion 52 of the insulator.

In the embodiment shown in FIG. 3, a channel 62 is formed around the lower portion 52 of the insulator. This configuration is designed to compliment the mounting configuration available in a refrigeration unit. Similarly, the centerline 66 and raised edges 64 of the top portion 50 of the insulator are designed to accommodate the physical space requirements dictated by the surrounding refrigeration unit.

To optimize the heat retaining ability of the insulator while consuming the least amount of space, the insulator of the present invention would be a cylindrical section of insulation material which surrounds the ends of fluorescent lamp 34.

Recognizing the practical necessities of building a device which can be readily incorporated into a existing low temperature application, it is often necessary to alter the physical configuration of the insulator to conform to the available space and mounting constraints of the surrounding area. As the insulator is formed of a flexible, thermal insulating material, such as neoprene or polyurethane foam, it is substantially economical to manufacture the insulator in an irregular shape in order to accommodate the surrounding structure.

Referring to FIG. 5, a cross-sectional view showing the space available for an insulator to be inserted between a fluorescent lamp and the surrounding diffuser or lens is shown. The fluorescent lamp 34 is separated from the surrounding enclosure 70 by a space 72. Referring to FIG. 6, this space 72 has been occupied by insulator portions 50 and 52. The shape of the space available matches the configuration of the insulator shown in FIG. 3.

Figure 7:
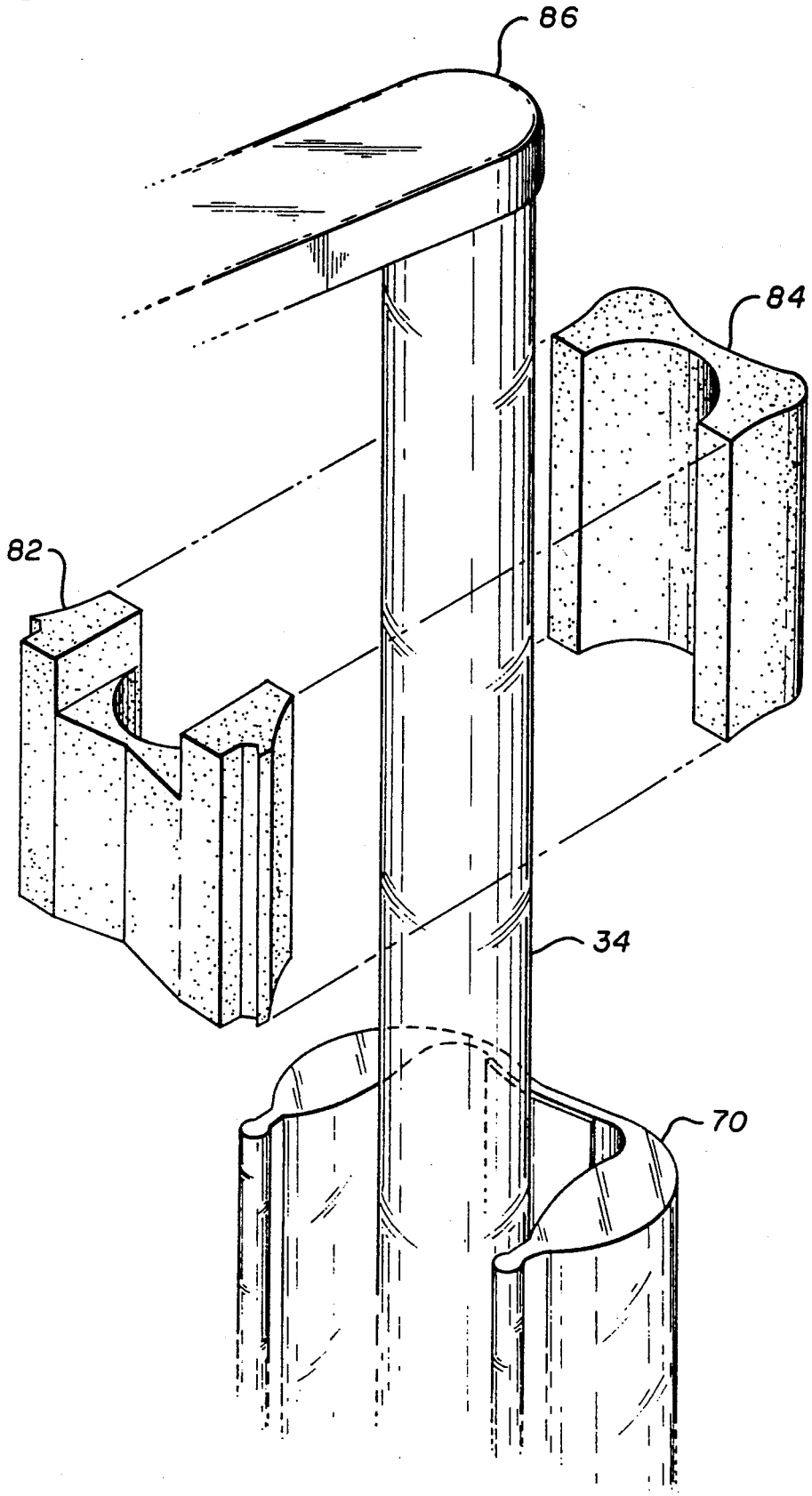
FIG. 7 is an exploded perspective view showing the fluorescent lamp and insulator of the present invention and a light socket at one end of a fluorescent tube.

Referring to FIG. 7, the shape of insulator 82 is similar to the shape of the bottom portion 52 of the insulator shown in FIG. 3, and the top portion 84 of the insulator shown in FIG. 7 is similar to the top portion 50 of the insulator shown in FIG. 3. The significant difference between the insulator shown in FIG. 3 and the insulator shown in FIG. 7 is that the insulator shown in FIG. 7 has been designed to accommodate the placement of the mounting bracket 86 which is in contact with the end of fluorescent lamp 34. The same lens and lamp protector 70 is placed around lamp 34 and the insulator portions 82 and 84 shown in FIG. 7.

Figure 9:
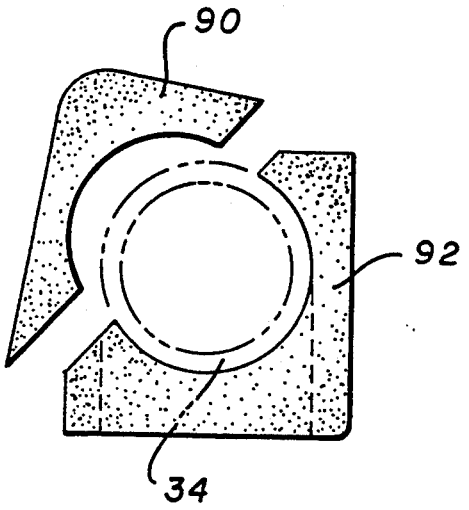
FIG. 9 is a cross-sectional view of the embodiments shown in FIG. 8 removed from the housing.
Figure 8:
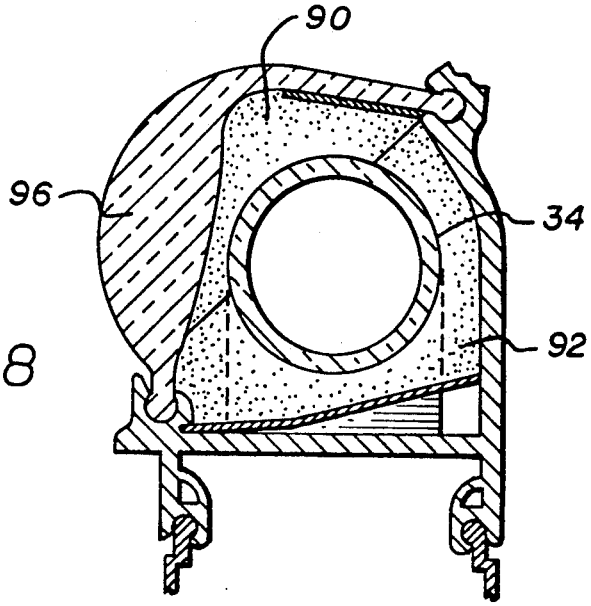
FIG. 8 is a cross-sectional view of another embodiment of the insulator of the present invention as located in a housing surrounding a fluorescent lamp.
Figure 10:
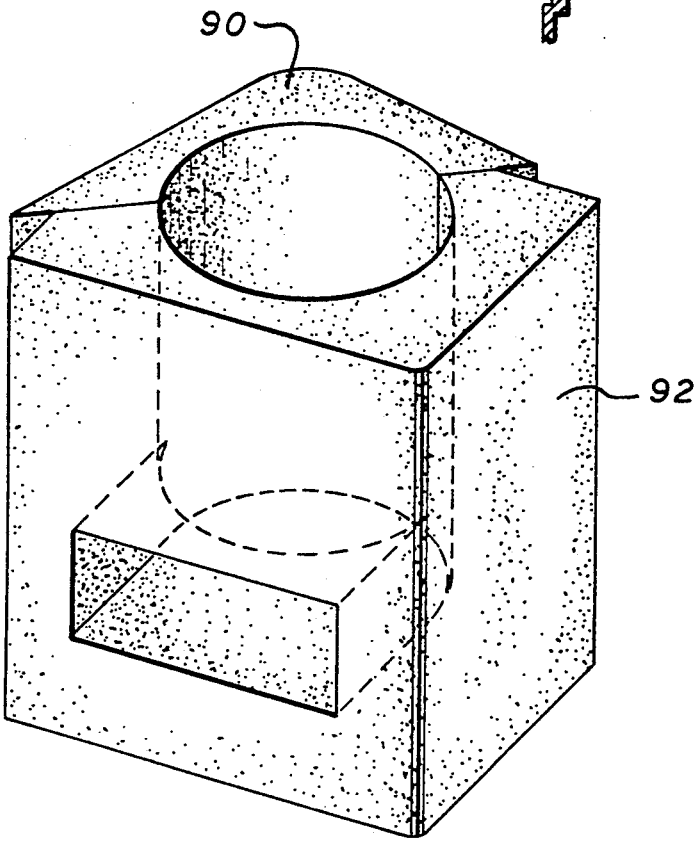
FIG. 10 is a perspective view of the insulator shown in FIGS. 8 and 9.

Referring now to FIGS. 8–10, there is shown an alternative embodiment of the present invention a top portion 90 and a bottom portion 92 of an insulator surrounds a fluorescent lamp 34 which is confined to the space defined by fluorescent cover 96. The top portion 90 and bottom portion 92 of the insulator shown in FIGS. 8, 9 and 10 is designed to accommodate an electrical contact similar to contact 86 shown in FIG. 7. This implementation differs from the implementation of FIG. 3 in which the electrodes 36 and 38 and 40 and 42 are enclosed by end portions 58 and 60 of the insulator shown in FIG. 3.

Referring to FIG. 4, the insulator shown in FIGS. 6 and 7 is preferred when a fluorescent lamp is mounted near the center of freezer 10, between doors 12 to illuminate goods placed on shelves 20. The insulator shown in FIGS. 8–10 is preferred for when a fluorescent lamp is mounted around the sides 14 of freezer 10. Glass 16 allows the illuminated contents of freezer 10 to be viewed from outside freezer 10. The dimensions shown in the drawings illustrate one preferred insulator size. Other sizes and dimensions are implemented to conform to the requirements of the particular application.

In constructing insulators of the present invention, it is preferable to employ a closed cell type foam over an open cell type foam. The disadvantage of an open cell type foam is that in the low temperature environment, moisture may accumulate on or near the insulator. An open cell type foam will more readily be susceptible to moisture absorption than a closed cell type insulator of the same configuration. In addition, it is desirable to coat or encapsulate the insulator of the present invention in a rubber like material in order to prevent moisture from seeping into the cell structure of the insulator. There are numerous rubberized paints and plastics which are suitable for this purpose.

In the preferred embodiment shown in FIG. 3, the dimensions of the lower portion 52 of the insulator are as follows:

The channel 62 is approximately ¼" high and sticks out approximately ⅛" on either side of the insulator. The distance between channels 62 is approximately 2", and the top of the lower portion 52 of the insulator is approximately 1.938" wide. The recess portion 56 of the insulator has a radius of approximately 0.5" as does portion 54 of the upper portion 50 of the insulator.

Upper portion 50 of the insulator shown in FIG. 3 is approximately 0.875" high when measured to the area of raised edge 64. The center line 66 is approximately 0.093" below the level of raised edge 64. Upper portion 50 of the insulator is approximately 1.938" wide at the bottom to match the dimension of the top part of the lower portion 52 of the insulator. The top part of the insulator is angled at the sides at approximately 7.5°, and has a radius of approximately 0.312" in order to show a gradual, curved surface approaching the raised edges 64 of the top portion 50 of the insulator.

End portions 58 and 60 of the insulator shown in FIG. 3 are approximately 0.38" wide, and the top portion 50 and bottom portion 52 of the insulator are approximately 1.88" in overall length.

Referring to the embodiments shown in FIGS. 9 and 10, the proposed dimensions of the insulator are approximately 1.438" square with a 0.5" radius defining the space available for fluorescent lamp 34. Upper portion 90 of the insulator is a cut away section which compliments portion 92 of the insulator. Portion 90 has one edge segment which has a radius of approximately 0.31". Portion 90 of the insulator is designed to slightly overlap the bottom portion of the insulator, and this is approximately 1.5" long, and 1" high.

Similar to the insulator shown in FIG. 3, the solid end portion of the insulator shown in FIGS. 9 and 10 is approximately 0.38" deep and the overall insulator approximately 1.88" long.

The materials used to manufacture the insulators is formed of a closed cell foam made of a non-moisture absorbing polymer. The continuous operating temperature is in excess of 180° F. One particular suitable material is a closed cell silicon, polyethylene, polypropelene, polystyrene, vinyl, or polyurathane foam having a density of from ½ to 20 lbs. such as Voltek, Volara #2A or Dow, ethafoam. Alternatively, a thermal plastic elastomer having a polymer base resin of silicon, olefin, urethane, styrene, or vinyl (with a Shore A density of 35 to 70), such as Monsanto Santoprene, Dupont Alcryn, or Shell Craton are acceptable, as are a thermal plastic rubber (35 to 70 Shore A) such as SBR, Buna N, NITRILE, or EPDM. The insulators may be fabricated in multiple segments and laminated back together in order to achieve the required design configuration. Additional considerations for materials include polyvinyl chloride (PVC), a crosslinked polyethylene (PE), and neoprene.

The insulators of the present invention will primarily benefit operation of a filament type fluorescent lamp. This is because a filament type fluorescent lamp is designed to generate heat from a filament. Insulators of the present invention will also enhance the operation of a two element type fluorescent lamp by generally retaining heat within the lamp, allowing the lamp to generate more light at lower temperatures with the same applied voltage. In this application, the insulator will not work as well as the insulator will with a filament type fluorescent tube because the construction of the two element type fluorescent lamp is not designed to generate heat at each of elements of the fluorescent lamp.

By raising the temperature of the gas within the dual filament type fluorescent lamp near the filament element, the energy input required by the fluorescent lamp is decreased. Since this energy is usually supplied in the form of a high voltage, the reduced energy requirement is directly reflected in reducing the required discharge voltage. The energy required to start a dual filament type fluorescent lamp when it is ignited from an off state does not change with the application of an insulator. Applying a pre-start current to the filament will locally warm the gas, reducing the energy required to start the lamp. The insulator of the present invention helps retain heat generated by the filament, and will help reduce the energy required to start the lamp. The energy required to start the lamp is almost always greater than the energy required to keep the lamp operating once it has been started. The additional starting energy will become available during normal operation in order to ensure a more complete discharge of the gas within the fluorescent lamp. This results in a greater light output than would otherwise result.

The present invention also allows application of a low energy signal to the filament elements of the fluorescent lamp in order to preheat them before the lamp is started and a high energy pulse applied to the filaments of the fluorescent lamp.

Dual element fluorescent lamps have exhibited a decreased life cycle when operated in cold environments as compared to ambient room temperature or warm environments. Presumably, this is because of the high energy which must be applied across the two element fluorescent lamp, and a non-conductive layer forming on either one or both of the elements which inhibits energy flow from or to the element, further increasing the amount of energy required to light a two element fluorescent lamp.

Ballast manufacturers make ballasts which provide a fairly constant voltage which is not substantially higher than the voltage required to light a two element fluorescent lamp. Degradation of either of the elements in this type of fluorescent lamp thus causes failure of the fluorescent lamp. Since a new fluorescent lamp may successfully light using the same ballast, the user is apt to merely replace the fluorescent lamp. Other difficulties may be that insufficient energy is available to cause all of the gas contained within the fluorescent lamp to become excited and discharge, creating light. This results in a reduced light output which may not be readily attributed to the temperature of the operating environment.

There has been described hereinabove, a novel insulator constructed according to the principles of the present invention. Those skilled in the art may now make numerous uses of and departures from the above described embodiment without departing from the inventive concepts which are defined solely by the scope of the following claims.

What is claimed is:

1. An insulator for a fluorescent lamp comprising:
an insulator material placed over at least one end of a fluorescent lamp having an electrode/filament to prevent loss of heat generated by the fluorescent lamp; and
wherein said insulator extends from the end of said fluorescent lamp towards the center thereof to a point slightly past the location of the electrode/-filament within the fluorescent lamp.

2. The apparatus described in claim 1 and further comprising a fluorescent lamp having at least one electrode located at either end thereof; and
said insulator surrounding at least one end of said fluorescent lamp.

3. The insulator of claim 1 wherein said insulator material comprises polyurethane foam.

4. The insulator of claim 3 wherein the insulator material encircles the portion of the lamp bulb and contacts the lamp bulb.

5. The insulator of claim 4 wherein the insulator is the only polymeric material which entirely encircles the lamp bulb.

6. A method of operating a fluorescent lamp including the steps of:
generating a discharge pulse in a ballast;
applying said discharge pulse to a fluorescent lamp, generating heat within the fluorescent lamp;
insulating said fluorescent lamp to retain the heat generated therein; and
wherein the insulation is applied only near the ends of the fluorescent lamp.

7. The method of claim 6 in which the fluorescent lamp is a dual filament type fluorescent lamp.

8. The method of claim 7 and further including the steps of:
heating said dual filaments of said fluorescent lamp; and
insulating said fluorescent lamp to retain a portion of the heat generated by said filament elements within said fluorescent lamp.

9. The method of claim 6 in which said fluorescent lamp operates in an environment having an ambient temperature of less than 7° C.

10. An insulator for surrounding the electrode/filament portion of fluorescent lamps used in low temperature applications comprising:
a fluorescent lamp bulb insulator material formed in an internal shape complimenting the external shape of the fluorescent lamp bulb, said insulating material placed over at least one end of the fluorescent lamp bulb to prevent loss of heat generated by the fluorescent lamp; and
wherein the insulator extends from the end of the fluorescent lamp to the end of the electrode/filament within the fluorescent lamp.

11. The insulator of claim 10 wherein said insulator is a polymeric material and is the only polymeric material which entirely encircles the bulb.

12. An insulator for a fluorescent lamp comprising:
a foam material placed over at least one end of a fluorescent lamp having an electrode/filament to prevent loss of heat generated by the fluorescent lamp; and
wherein said foam material extends from the end of said fluorescent lamp towards the center thereof to a point slightly past the location of the electrode/-filament within the fluorescent lamp.

13. The insulator of claim 12 wherein said foam material comprises polyurethane foam.

* * * * *